US009537268B2

(12) United States Patent
Kellman

(10) Patent No.: US 9,537,268 B2
(45) **Date of Patent: *Jan. 3, 2017**

(54) INTEGRATED CORD TIE AND SIGNAL CONDUCTING DEVICE

(71) Applicant: NUDL INNOVATIONS, LLC, Asheville, NC (US)

(72) Inventor: Harvey Kellman, Asheville, NC (US)

(73) Assignee: NUDL INNOVATIONS, LLC, Asheville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/016,558

(22) Filed: Feb. 5, 2016

(65) Prior Publication Data

US 2016/0156141 A1 Jun. 2, 2016

Related U.S. Application Data

(63) Continuation of application No. 14/722,414, filed on May 27, 2015, now Pat. No. 9,257,758, which is a continuation of application No. 14/713,212, filed on May 15, 2015, now abandoned.

(60) Provisional application No. 62/002,960, filed on May 26, 2014.

(51) Int. Cl.

| | |
|---|---|
| ***H01R 11/00*** | (2006.01) |
| ***H01R 13/72*** | (2006.01) |
| ***H01R 4/20*** | (2006.01) |
| ***H01R 43/26*** | (2006.01) |
| ***H01R 13/60*** | (2006.01) |
| ***H01R 31/06*** | (2006.01) |
| *H01R 24/58* | (2011.01) |

(52) U.S. Cl.

CPC ..... *H01R 13/72* (2013.01); *H01R 4/20* (2013.01); *H01R 11/00* (2013.01); *H01R 13/60* (2013.01); *H01R 31/06* (2013.01); *H01R 43/26* (2013.01); *H01R 24/58* (2013.01); *Y10T 29/4921* (2015.01); *Y10T 29/4922* (2015.01)

(58) Field of Classification Search

CPC ..... H01R 11/00; H01R 4/20; H01R 43/26

USPC ..... 439/502, 507, 278, 399, 445, 447, 450, 439/452, 455, 456, 459, 460, 463, 464, 439/465, 466, 467, 468, 471, 569, 606, 439/668, 901, 936, 578–595, 512, 499; 362/198, 191, 362/199, 419; 174/72 R, 174/76, 93, 68.1, 68.3, 73.1, 86, 89, 174/140 R, 140 S, 13, 40, 69, 135, 70 S, 174/84 R

See application file for complete search history.

(56) References Cited

U.S. PATENT DOCUMENTS

| | | | | |
|---|---|---|---|---|
| 4,965,877 | A * | 10/1990 | Gunn | 363/146 |
| 6,280,050 | B1 * | 8/2001 | Bird et al. | 362/198 |
| 6,790,077 | B1 * | 9/2004 | Chen | 439/502 |
| 7,200,856 | B2 * | 4/2007 | Perlman | 725/82 |
| D616,292 | S | 5/2010 | Martinson | |

(Continued)

*Primary Examiner* — Abdullah Riyami
*Assistant Examiner* — Harshad Patel
(74) *Attorney, Agent, or Firm* — DLA Piper LLP (US)

(57) ABSTRACT

In one embodiment, an integrated extension cable/cord tie device includes male jack, a female jack, and a cable connected to the male jack and female jack. The cable comprises at least one electrical conductor forming an electrical connection between the male jack and the female jack, and a mechanical component that allows the cable to be bent to at least partially around an object upon the application of a first force, to substantially retain its shape after removal of the first force so as to remain at least partially around the object after removal of the first force, and to be unbent upon the application of a second force to be removed from the object. In another embodiment, the mechanical component is integrated directly into a non-detachable cord of a device or a detachable cord usable with one or more devices.

15 Claims, 9 Drawing Sheets

(56) References Cited

U.S. PATENT DOCUMENTS

| | | | | |
|---|---|---|---|---|
| 8,033,860 | B2 * | 10/2011 | Milstein et al. | 439/502 |
| 8,210,868 | B1 * | 7/2012 | Robling et al. | 439/502 |
| 8,974,242 | B2 * | 3/2015 | Lee et al. | 439/278 |
| 2006/0013410 | A1 * | 1/2006 | Wurtz | 381/74 |
| 2010/0215186 | A1 * | 8/2010 | Chang | 381/74 |

* cited by examiner

INTEGRATED CORD TIE AND SIGNAL CONDUCTING DEVICE

CROSS-REFERENCE TO RELATED APPLICATIONS

This application is a continuation of U.S. patent application Ser. No. 14/722,414 filed May 27, 2015, which is a continuation of U.S. patent application Ser. No. 14/713,212 filed May 15, 2015 (now abandoned), which claims the benefit of U.S. Provisional Application No. 62/002,960 filed May 26, 2014, which are incorporated by reference in their entireties.

BACKGROUND

Wired audio headphones (as used herein, "headphones" includes any type of device capable of producing audible sounds in response to electrical signals conducted via one or more cords, and that is worn on the head or a part thereof, including but not limited to those of the type sometimes referred to as earbuds, headsets, earphones, and the like, and includes devices with one or two ear pieces) have become more widely used in recent years, particularly in connection with portable audio devices such as the APPLE IPOD™ and smartphones with audio storage capabilities and streaming audio services such as PANDORA™ and SPOTIFY™. The very mobility of these devices has exacerbated a problem—how to store the headphones when not in use in a way that the headphone cord does not become tangled or caught on other objects, particularly when the user is away from his or her home or office. Tangled headphone cords can be messy and inconvenient, and damage to the headphones can occur when a headphone cord becomes caught on another object.

One solution to this problem is a product known as GEAR TIES™, shown in FIG. 1. The GEAR TIES™ product of FIG. 1 is three inches long and is made of a material that retains its shape when deformed. As disclosed on the manufacturer's website (www.niteize.com/product/Gear-Tie-3.asp), the GEAR TIES™ product comprises "a fully bendable wire interior and colorful, durable, soft rubber exterior." The GEAR TIES™ product is used to wrap around the headphone cord so that the headphone cord is stored in a neat bundle as shown in FIG. 1. One problem with the GEAR TIES™ product is that there is no convenient way to store the product when the headphones are in use. It is possible to wrap the GEAR TIES™ product around the headphone cord when the headphone is in use, but doing so can be annoying to a user because the GEAR TIES™ product would slide along the cord during relative movement between the portable audio device and the headphones. If the GEAR TIES™ product is stored separately from the headphones while the headphones are in use, it can become lost. Other cord storage solutions also suffer from drawbacks. Cord storage bags and twist-tie types of cord ties (the type in which the cord tie ends are twisted around each other) can, like the GEAR TIES™ product, become lost when separated from the headphones. Velcro straps are cumbersome and can become engaged with other material when not being used to secure headphone cords.

DETAILED DESCRIPTION OF SEVERAL EMBODIMENTS

In one embodiment, a short extension cable compatible with the headphone cable is integrated with a cord tie. As used herein, "extension cable" means a cable that includes a proximal end having a connector configured to make a detachable electrical connection to the conductors of a headphone cable, typically via the male jack at the end of the headphone cable, and a distal end having a connector configured to make a detachable electrical connection to a device that supplies an audio signal. The proximal end of the extension cable may have a female jack configured to mate with the male jack of the headphone cable, and the distal end may have a male jack configured to mate with a female jack on a portable audio device (i.e., the male jack at the distal end of the extension cable may be configured to mate with the same female jack for which the male jack of the headphone cable is configured). When the male headphone jack is configured to mate with the female jack of the portable audio device, this means that the male and female jacks of the extension cable are capable of mating with each other. In some embodiments, the extension cable can also act as an adapter with dis-similar connectors on each end (e.g., a female connector at a proximal end that is not configured to mate a male connector at the distal end), or with connectors or jacks of the same sex (which may or may not be dis-similar) on both ends. In this way, the extension cable can connect a headphone with a male jack that is not configured to mate with a female jack of the portable audio device. In yet other embodiments, the extension cable, whether or not it is an adapter, can be long. Such an adapter can serve as the primary or only cord/cable for headphones such as headphones with removable cords/cables.

Figure 1:
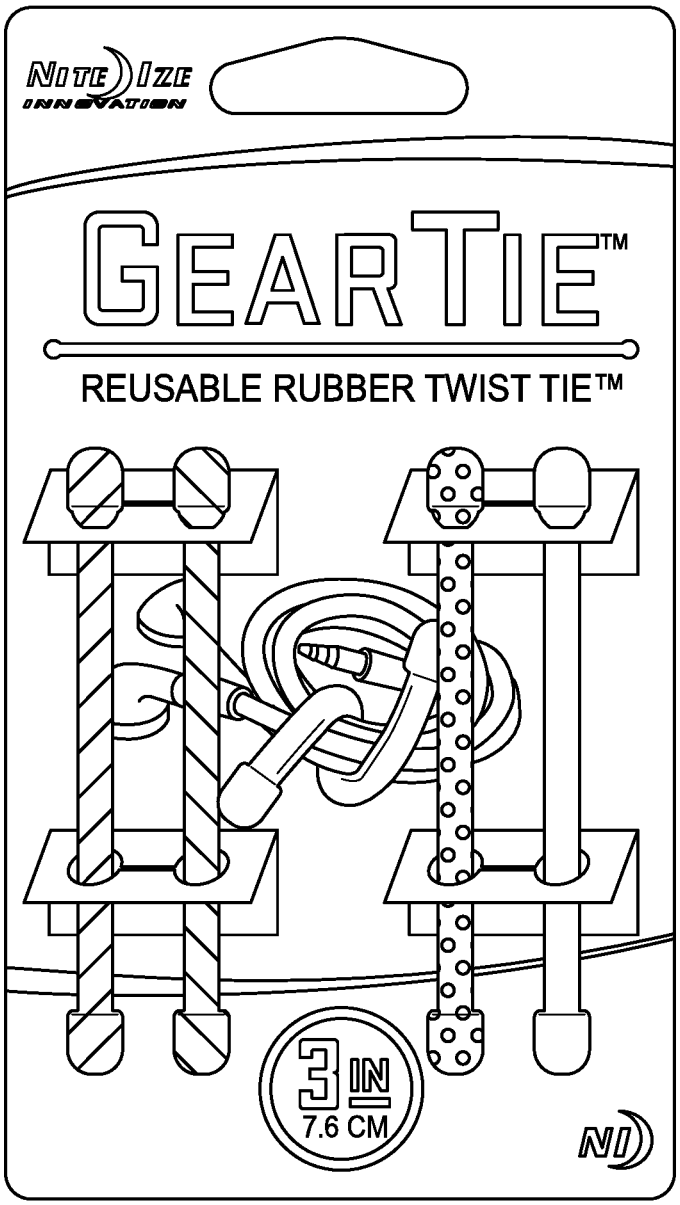
FIG. 1 PRIOR ART
FIG. 1 is a drawing of a prior art cord tie.
Figure 2:
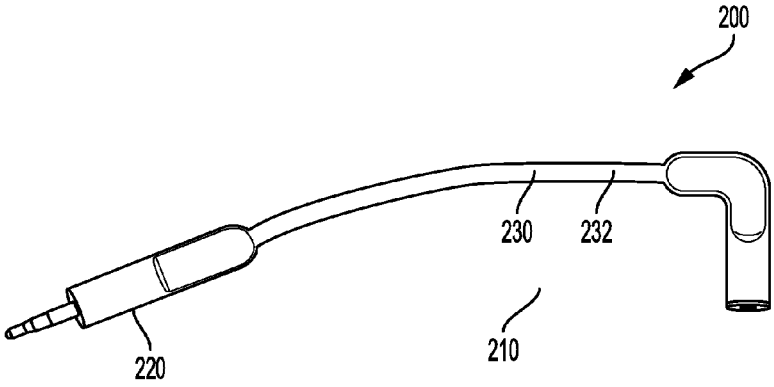
FIG. 2 is a drawing of an integrated extension cable/cord tie device according to one embodiment.

An embodiment of an integrated extension cable/cord tie device 200 is illustrated in FIG. 2. The device 200 has a female jack 210 at a proximal end and a male jack 220 at a distal end. The female jack 210 is preferably capable of mating with the male jack 220. Thus, in this embodiment, the integrated extension cable/cord tie device 200 will be used with a portable audio device and headphones including jacks that are configured to mate with each other. The female jack 210 and the male jack 220 are connected via a cable 230. In the embodiment of FIG. 2, the female jack 210 has a right angle bend but the male jack 220 does not. In other embodiments, the male jack 220 also has a right angle bend.

In yet other embodiments, neither jack 210, 220 has a right angle bend, or the male jack 220 has a right angle bend and the female jack 210 does not.

The cable 230 includes conductors (typically 2-3; not shown in FIG. 2) sufficient to provide an electrical connection between the female jack 210 and the male jack 220. As is known to those of skill in the art, stereo headphones typically require three conductors (right, left, ground) while mono headphones typically require only two conductors (audio and ground). Other numbers of conductors are possible, and any number of conductors may be included in accordance with this and other embodiments of the invention.

The cable 230 also includes one or more components (not shown in FIG. 2) that provides mechanical properties to the cable 230 that make the device 200 suitable for use as a cable tie. These mechanical properties may include the following. First, the cable 230 should bend upon the application of a force applied by a human hand to the cable 230 with only a modest effort by a typical user, which includes young children of an age that typically use portable audio devices. A non-limiting range of such a force is 0.25-20 foot-pounds, and is more preferably 0.5-10 foot-pounds. Second, the deformation should be either non-elastic or only slightly elastic, such that the deformation achieved upon the application of the force will remain entirely or substantially entirely after the force is removed. Third, the cable 230 should remain intact over a substantial number (e.g., greater than 100) of deformations, including repeated bending and unbending at the same point or points on the cable 230. The aforementioned mechanical properties may be provided by a component in the form of a single wire, such as a wire of the type used in the GEAR TIES™ product discussed above, or multiple wires. Exemplary materials for the wire component include a 16-20 gauge solid wire made from steel or aluminum alloys with good resistance to fatigue, but those of skill in the art will recognize that other materials may also be used. In some embodiments, the component that provides the mechanical properties may be the same as one or more of the electrical conductors through which the audio signal passes (e.g., the ground conductor); in other embodiments, the component that provides the mechanical properties may be separate from and in addition to the electrical conductors. The cable may include an outer jacket 232, which in some embodiments may be the component, or a portion of the component, that provides the aforementioned mechanical properties.

Figure 3:
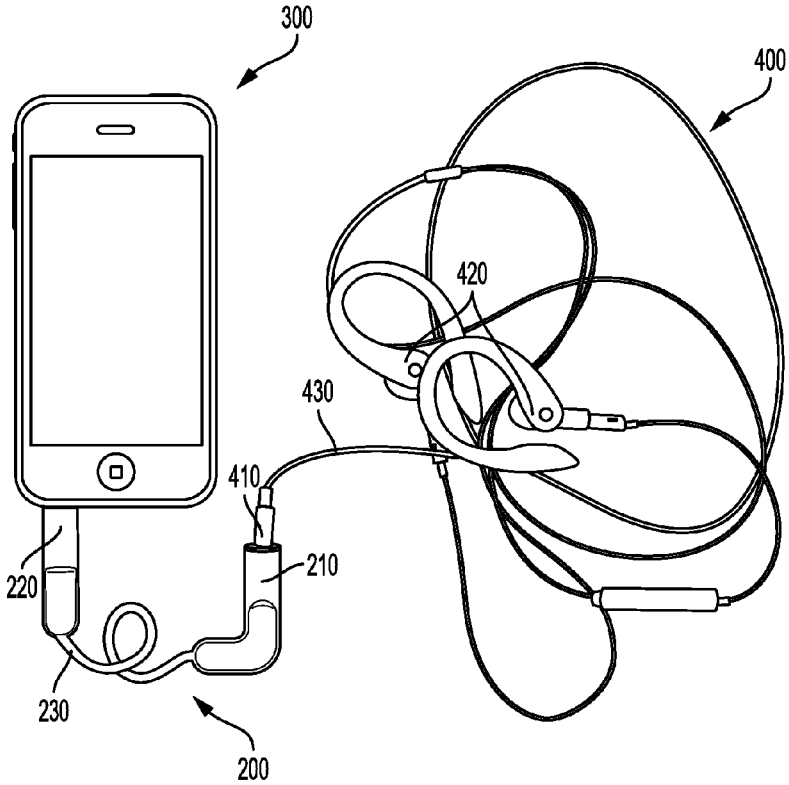
FIG. 3 is a drawing showing the integrated extension cable/cord tie device of FIG. 2 being used in connection with a portable audio device and headphones.

FIG. 3 illustrates how the device 200 may be used in connection with a portable audio device 300 and headphones 400. When the user is listening to audio from the portable audio device 300 with the headphones 400, the male jack 220 of the device 200 is inserted into a female jack (not shown in FIG. 3) of the portable audio device 300. The male jack 410 of the headphones 400 is inserted into the female jack 210 of the device 200. This creates electrically conducting paths from the female jack of the audio device 300 to each of the ear pieces 420 of the headphones 400 so the user can hear audio via the headphones 400. In this configuration, the integrated extension cable/cord tie device 200 extends the length of the headphone cable 430, but the principal advantage of this configuration is that the integrated extension cable/cord tie device 200 will not be lost or misplaced as it attached at one end to the portable audio device 300 and on the other end to the headphones 400.

Figure 4:
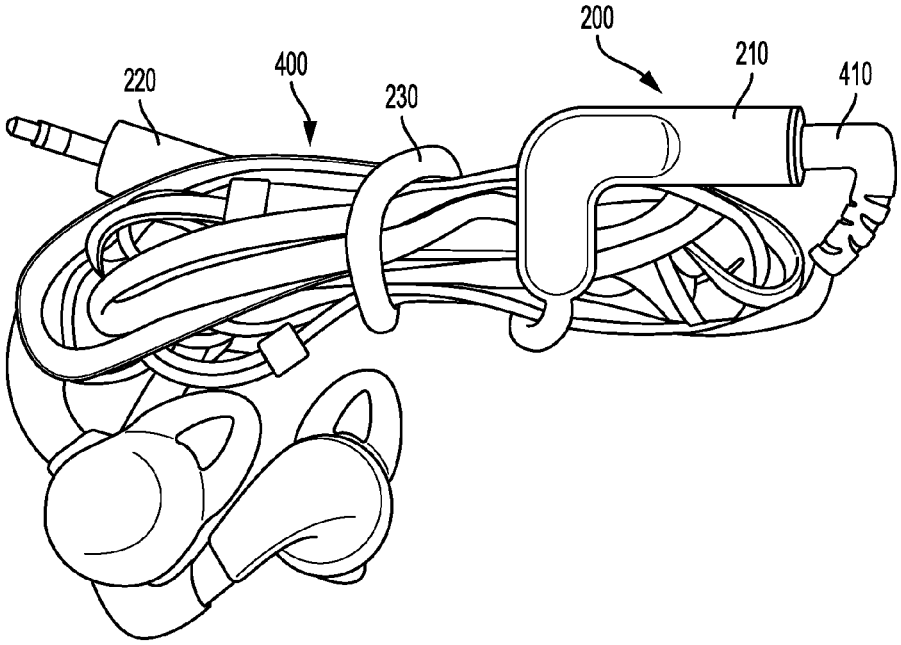
FIG. 4 is a drawing showing the integrated extension cable/cord tie device of FIG. 2 being used in as a cord tie for the cord of the headphones of FIG. 3.

FIG. 4 illustrates how the integrated extension cable/cord tie device 200 may be used when the user is not listening to audio from the portable audio device 300. In this situation, if the user separates the headphones 400 from portable audio device 300 and wishes to store the headphones 400, the cable 230 of the integrated extension cable/cord tie device 200 may be wrapped around the bundled headphone cable 430 to keep the headphone cable 430 neatly bundled when not in use. FIG. 4 illustrates the headphone male jack 410 inserted into the female jack 210 of the device 200 (which is facilitated by the right angle bend in the male jack 410), but this is not necessary in this configuration.

Figure 5:
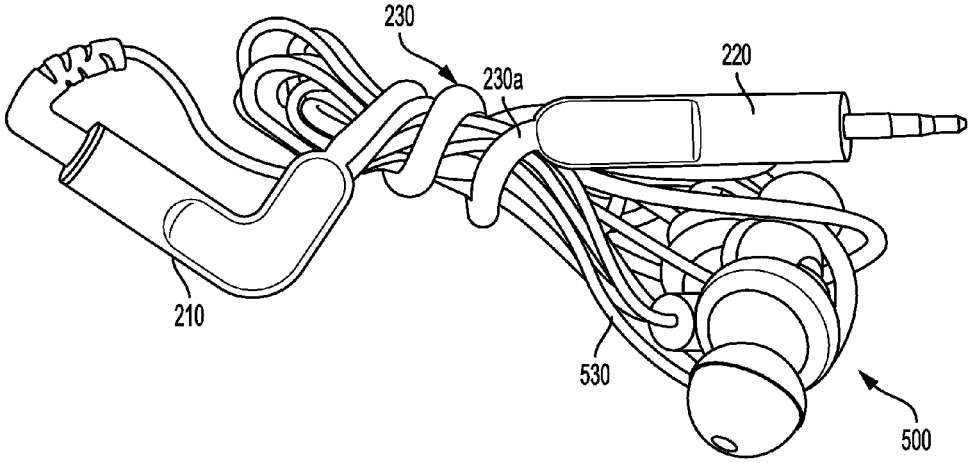
FIG. 5 is a drawing showing the integrated extension cable/cord tie device of FIG. 2 being used in as a cord tie for the cord of different headphones.

An example of the use of the integrated extension cable/cord tie device 200 with a different headphone 500 is shown in FIG. 5. As in FIG. 4, the cable 230 of the integrated extension cable/cord tie device 200 may be wrapped around the bundled headphone cable 530 to keep the headphone cable 530 neatly bundled when not in use. Also shown in FIG. 5 is a bend 230*a* in the cable 230 of the device 200 near the male jack 220. The bend 230*a* has been formed by the user to align the male jack 220 with the bundled headphone cable 530 in order to minimize the space of the combined device 200 and bundled headphone 400. In some embodiments, the male jack 220 and/or the female jack 210 of the device 200 includes a right angle bend or a bend lesser than 90 degrees (e.g., a 45 degree bend) to facilitate this alignment while minimizing stress on the cable 230.

Figure 6:
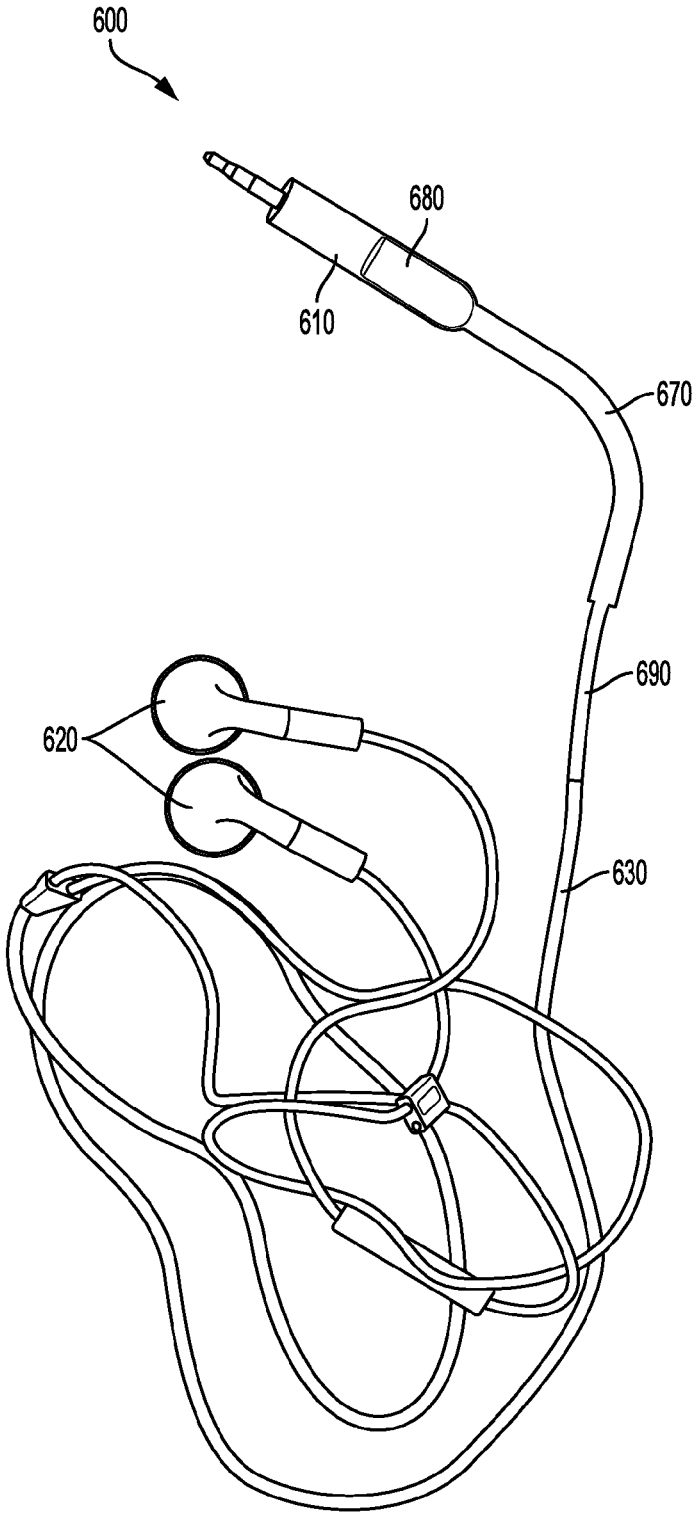
FIG. 6 is a drawing showing a headphone having a cord with an integral cord tie device according to another embodiment.
Figure 7:
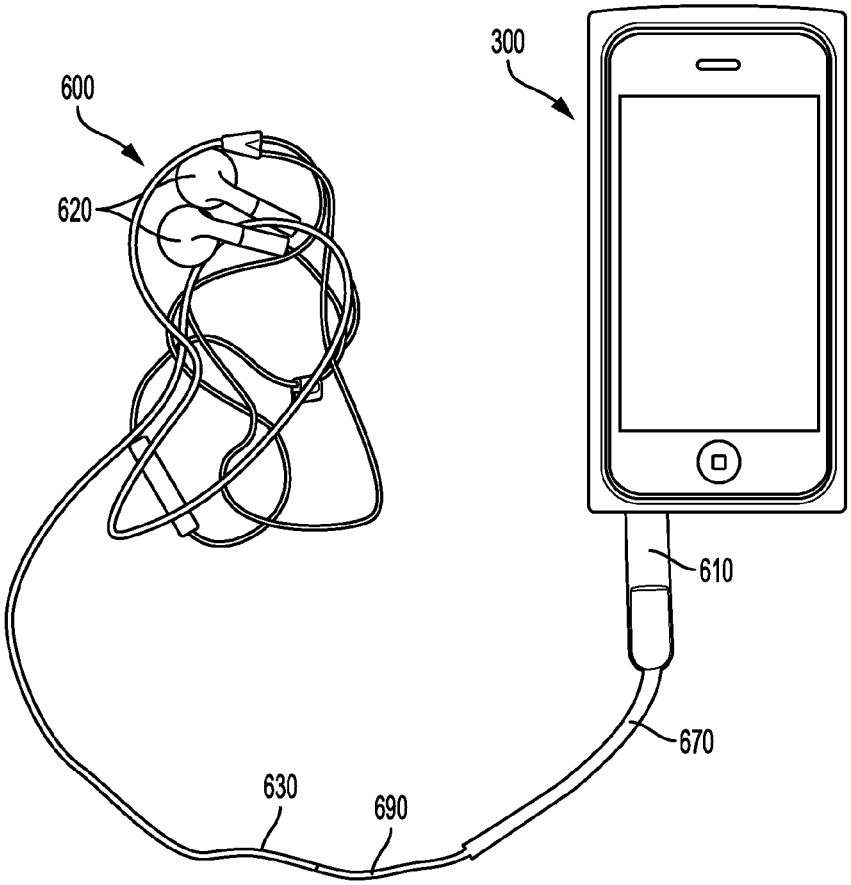
FIG. 7 is a drawing showing the headphone of FIG. 6 connected to a portable audio device.
Figure 8:
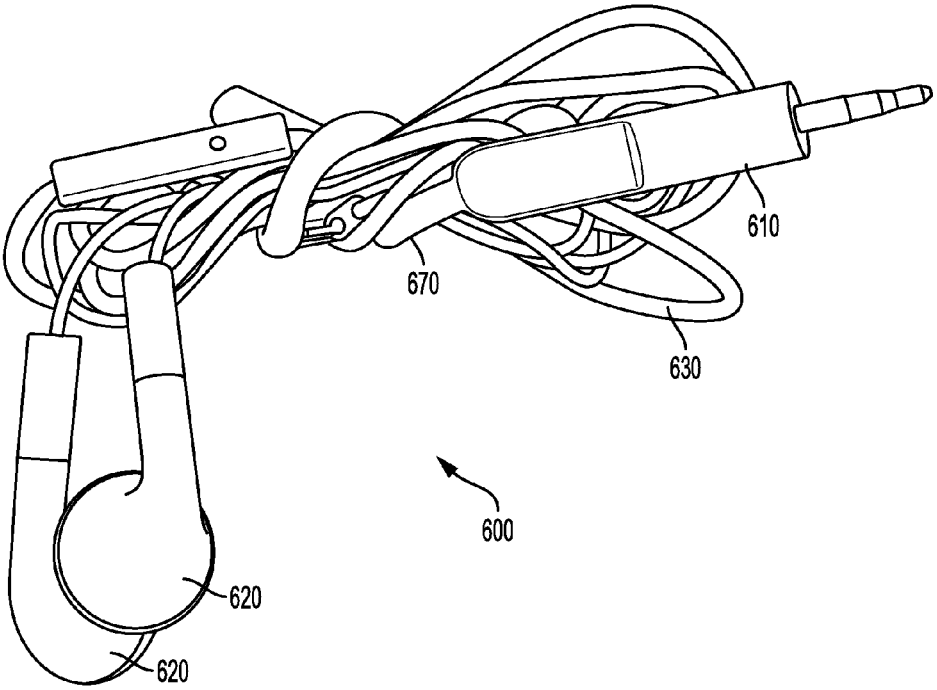
FIG. 8 is a drawing showing the headphone of FIG. 6 with the cord bundled using the integral cord tie device.

In a second embodiment of the invention, the mechanical component discussed above may be integrated directly into a portion of the cord of the headphones, such as near the end of the cord in proximity to the jack. An example of such an embodiment is shown in FIG. 6. The headphones 600 of FIG. 6 include a male jack 610 electrically connected to earpieces 620 via a cord 630. A portion 670 of the headphone cord 630 near the jack 610 includes an integral mechanical component similar to the mechanical component discussed above in connection with the embodiment of FIG. 2 that allows the portion 670 to act as a cord tie for the remainder of the cord 630. The integral mechanical component of the portion 670 may be formed of the same materials and have the same properties discussed above in connection with the embodiment of FIG. 2. As shown in FIG. 6, heat shrink 690 is in place around the cord 630 in the area of an end of the portion 670 opposite the male jack 610. In some embodiments, a strain relief similar to the strain relief 680 adjacent the jack 610 or other form of strain relief known to those of ordinary skill in the art is used in addition to or in place of the head shrink 690. FIG. 7 illustrates the headphones 600 connected to portable audio device 300. FIG. 8 illustrates use of the portion 670 to secure the headphone cable 630 of the headphones 600. This embodiment of the invention is advantageous in that it is easier to use because no additional connection as in the case of the extension cable embodiment discussed above is necessary. However, this embodiment cannot be retrofitted as can the extension cable embodiment discussed above.

Figure 9:
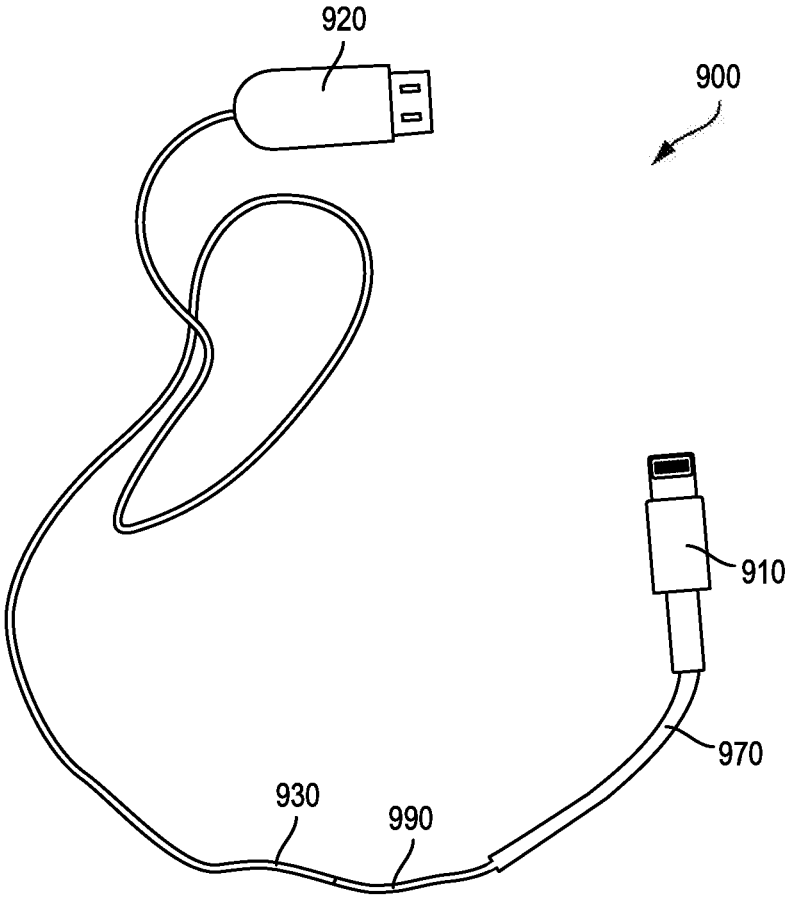
FIG. 9 is a drawing showing an integrated charging and data cable/cord tie device according to another embodiment.

Another embodiment of an integrated extension cable/cord tie device 900 of the type typically used for charging and/or transferring data from smartphones, is illustrated in FIG. 9. The device 900 includes a mini-USB or micro-USB jack 910 on one end of the cable 930, and a standard USB 920 jack on the other end of the cable 930. A portion 970 of the cable 930 near the jack 910 includes a mechanical component similar to the mechanical component discussed above in connection with FIGS. 2 and 6. As shown in FIG. 9, a heat shrink 990 extends over and beyond the portion 970 of the cable 930 including the aforementioned mechanical component. In other embodiments, jacks (e.g., LIGHTNING™ jacks for Apple iPhone6 smart phones) other than those shown in FIG. 9 may be used. In other embodiments, the portion 970 of the cable 930 including the mechanical component is located on the opposite end of cable 930.

Figure 10:
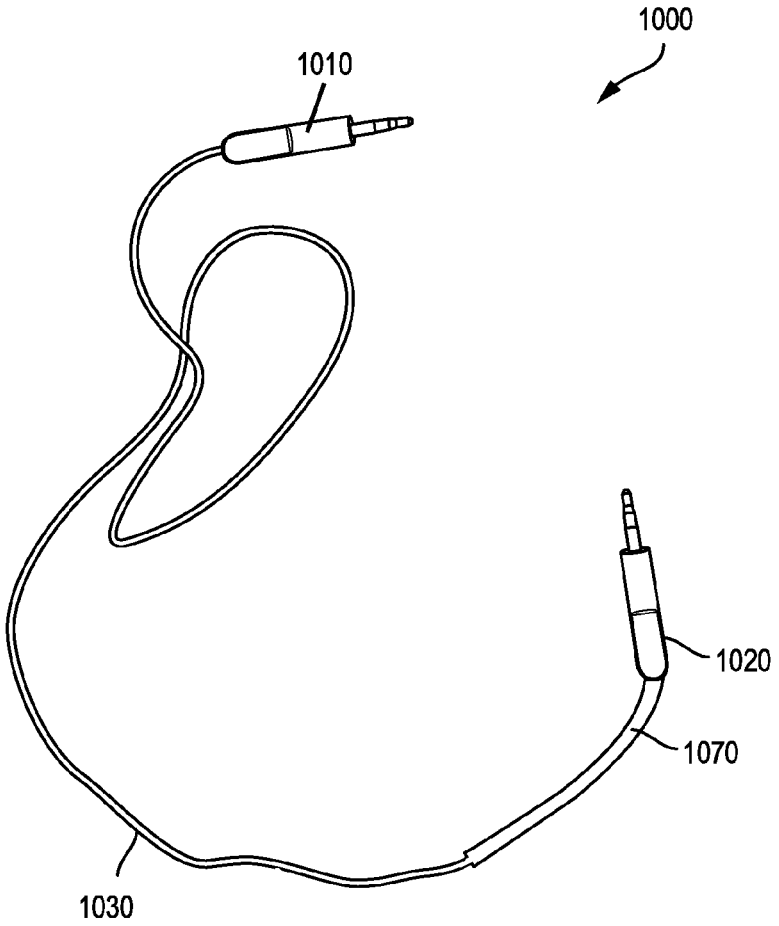
FIG. 10 is a drawing showing an integrated stereo cable/cord tie device according to yet another embodiment.

FIG. 10 illustrates an embodiment of an integrated headphone cable/cord device 1000 that serves as the primary or only cord/cable for a pair of headphones as discussed above. The device 1000 may be used in connection with headphones that do not include any integral cable but rather only include a female jack. The device 1000 includes a first male jack 1010 configured to mate with the female jack on such headphones (not shown in FIG. 10), and a second male jack 1020 configured to mate with a female jack on an audio device (not shown in FIG. 10) on opposite ends of cable 1030. In some embodiments, the male jacks 1010, 1020 are identical. In other embodiments, they are different (e.g., a 2.5 mm sub-miniature stereo jack 1010 and a 3.5 mm miniature stereo jack 1020). In yet other embodiments, one jack is male and the other is female, and the male and female jacks on such embodiments may or may not be configured to mate with each other (i.e., the male and female jacks on such embodiments may be of different types). The cable 1030 includes a portion 1070 near the jack 1020 includes a mechanical component similar to the mechanical component discussed above in connection with FIGS. 2, 6 and 9.

Those of skill in the art will recognize that the integrated extension cable/cord tie devices described above can be used with any device that includes a cord through which an electrical connection (for transmission of power or information or both) is made. Examples of such devices include a power supply for a laptop computer (e.g., the extension cable/cord tie device may be configured to be placed between a jack of the power supply and the laptop); a wired mouse; a wired power tool, etc. Similarly, those of skill in the art will recognize that the mechanical component discussed above could be integrated into any component that includes a main device and a cord that conducts power and/or information signals. The term "jack" as used herein is a broad term that refers to both male and female connectors and receptacles that facilitate removable temporary electrical connections when used with a corresponding device of the opposite gender, and includes devices that may also be referred to as connectors and/or plugs (e.g., RJ-45, micro-USB and LIGHTNING™ types) as well as devices that are typically referred to as jacks (e.g., 3.5 mm miniature and 2.5 mm sub-miniature stereo types).

The invention has been discussed above in connection with preferred embodiments. These preferred embodiments are exemplary only, and the invention is only limited other than by the following claims. Moreover, the abstract is intended to provide a quick indication of the subject matter to interested parties and does not limit the following claims.

What is claimed is:

1. An integrated cable/cord tie device comprising:

a first male jack configured to mate with a female jack of a smartphone;

a first female jack configured to mate with a male jack of a headphone, the male jack of the headphone being configured to mate with the female jack of the smartphone; and a cable connected to the first male jack and the first female jack;

wherein the cable comprises at least one electrical conductor forming an electrical connection between the first male jack and the first female jack, and wherein a first portion of the cable having a length less than a length of the cable includes a mechanical component that allows the first portion of the cable to be bent at least partially around a second portion of the cable upon the application of a first force, and wherein the first portion of the cable substantially retains its shape after removal of the first force so as to remain at least partially around the second portion of the cable after removal of the first force, and allows the first portion to be unbent from around the second portion of the cable upon the application of a second force.

2. The integrated cable/cord tie device of claim 1, wherein the mechanical component is the electrical conductor.

3. The integrated cable/cord tie device of claim 1, where in the mechanical component and the electrical conductor are different components of the cable.

4. The integrated cable/cord tie device of claim 1, wherein the cable comprises three electrical conductors connected to the first male jack and the first female jack.

5. The integrated cable/cord tie device of claim 1, wherein the mechanical component is a wire not electrically connected to the first female jack or the first male jack.

6. The integrated cable/cord tie device of claim 1, wherein the cable comprises an outer jacket.

7. The integrated cable/cord tie device of claim 1, wherein the first male jack comprises a right angle bend.

8. The integrated cable/cord tie device of claim 1, wherein the first female jack comprises a right angle bend.

9. A device comprising:

a functional component; and a cord having a first end electrically connected to the functional component, a second end including a connecting component, and an electrical conductor that electrically connects the first end to the connecting component;

wherein the cord includes an integral mechanical component having a length less than a length of the cord that allows the cord to be bent to at least partially around an object upon the application of a first force, to substantially retain its shape after removal of the first force so as to remain at least partially around the object after removal of the first force, and to be unbent upon the application of a second force to be removed from the object.

10. The device of claim 9, wherein the functional component is at least one headphone and wherein the connecting component is a headphone jack.

11. The device of claim 10, wherein the jack is a male jack.

12. The device of claim 10, wherein the connecting component is a power plug.

13. The device of claim 9, wherein the mechanical component is the electrical conductor.

14. The device of claim 9, wherein the cord comprises a plurality of electrical conductors that electrically connect the connecting component to the functional component.

15. The device of claim 14, wherein the cord comprises three electrical conductors that electrically connect the connecting component to the functional component.

* * * * *